United States Patent [19]

Schneider

[11] 4,427,392

[45] Jan. 24, 1984

[54] PEDAL DRIVEN OUTBOARD PROPELLER AND STEERING ASSEMBLY

[76] Inventor: Harold J. Schneider, 7801 SE. Pacific #13, Lacey, Wash. 98503

[21] Appl. No.: 264,672

[22] Filed: May 18, 1981

[51] Int. Cl.[3] ..... B63H 16/00

[52] U.S. Cl. ..... 440/30

[58] Field of Search ..... 440/26, 27, 21, 29, 440/30, 31, 60, 58, 63, 59; 114/156, 154

[56] References Cited

U.S. PATENT DOCUMENTS

| | | | |
|---|---|---|---|
| 638,132 | 11/1899 | Marx . | |
| 816,755 | 4/1906 | Spence . | |
| 954,718 | 4/1910 | Cutler . | |
| 1,793,528 | 2/1931 | Szabo . | |
| 1,826,507 | 10/1931 | Crosby . | |
| 2,172,401 | 9/1939 | Nelson . | |
| 2,487,195 | 11/1949 | Stephens . | |
| 2,523,674 | 9/1950 | Baker . | |
| 2,684,045 | 7/1954 | Cato, Sr. . | |
| 2,703,065 | 3/1955 | Gresham . | |
| 3,010,423 | 11/1961 | Sanders | 440/58 |
| 3,211,125 | 10/1966 | Yarbrough . | |
| 3,377,976 | 4/1968 | Gustine . | |
| 4,318,700 | 3/1982 | Price | 440/26 |

*Primary Examiner*—Trygve M. Blix
*Assistant Examiner*—Patrick W. Young
*Attorney, Agent, or Firm*—Delbert J. Barnard

[57] ABSTRACT

An outboard propeller drive and steering assembly for a boat. The assembly has an upper housing enclosing an upper drive shaft portion and a steering device support. There is a lower housing depending from the upper housing to support the propeller and rudder. The drive shaft extends through the upper and lower housings and is connected in the lower housing to drive the propeller. A steering device is within and extends from the upper housing and is connected to the lower housing to rotate the same, and the propeller relative to the drive shaft. There is a bicycle-type driving system adapted to be supported in the boat and connected to the drive shaft in the upper housing to rotate the drive shaft. A steering control is adapted to be supported in the boat and connected to the steering device in the upper housing to rotate the device. Bicycle pedals operate the driving system and are positioned to be rotated by an operator in an aft facing position to propel the boat in any direction. A handle on the steering control is adapted to be gripped by the operator in the aft facing position to steer the boat in any direction while propelling the boat.

3 Claims, 4 Drawing Figures

PEDAL DRIVEN OUTBOARD PROPELLER AND STEERING ASSEMBLY

DESCRIPTION

1. Technical Field

The invention relates to a combination of a propeller drive and steering assembly for a boat. The propeller is driven by pedal means as used in a bicycle drive system and the steering device is operated by a handle positioned adjacent the seat of the operator in the boat.

2. Background Art

In many boat operations, particularly such operations as hunting and fishing, it is desirable to have both hands free for action necessary to do the respective sports. It is also desirable to have a noiseless means of propulsion which would not scare the game away. Another feature desired is the slow steady propulsion that can be accomplished for trolling with pedal propelled boats which have been used in the prior art.

A search of the patent literature discloses a number of systems which propose solutions to the foregoing problems. For example, Yarbrough U.S. Pat. No. 3,211,125; Gresham U.S. Pat. No. 2,703,065; Cutler U.S. Pat. No. 954,718 and Spence U.S. Pat. No. 816,755 disclose a pedal powered drive for a boat propeller wherein the pedals are positioned forwardly of the operator's seat and the operator must face forwardly while he is pedalling to drive the boat.

The following patents disclose systems related or similar to those described above but not as pertinent to the present invention:

U.S. Pat. No. 638,132—Marx
U.S. Pat. No. 2,684,045—Cato
U.S. Pat. No. 1,793,528—Szabo
U.S. Pat. No. 2,487,195—Stephens
U.S. Pat. No. 2,172,401—Nelson
U.S. Pat. No. 2,523,674—Baker
U.S. Pat. No. 3,377,976—Gustine
U.S. Pat. No. 1,826,507—Crosby

DISCLOSURE OF THE INVENTION

The invention is a propeller drive and steering assembly adapted to be supported on the transom of a boat in a position so that an operator can sit facing the stern, and pedal a bicycle-type chain and sprocket assembly to drive the propeller to move the boat in any direction. Incorporated in the assembly is a steering device operable by simple hand rotary movements by which the propeller is rotated relative to the drive shaft along with a small rudder, the extent of rotation being 360 degrees.

A particular advantage of the present invention is the provision of the ability of the operator to propel the boat while facing toward the stern and being able to troll with both hands free. It is only on rare occasions that it is necessary for the operator to steer the boat which he can easily accomplish with the use of one hand.

In more and more lakes, power driven boats are being prohibited, thus the present invention is particularly advantageous. In the use of the present invention, the operator is in the same position that an operator would be rowing the boat as in the prior art, but as his hands are completely free for handling a fishing rod during trolling, this arrangement provides easy control. The operator need only turn his head occasionally to determine whether the boat is headed in the proper direction.

The advantages of the present invention are clear with respect to the more modern prior art in which the boats may be pedalled with the operator sitting in the forwardly direction, not being in a position to troll.

The present invention is comprised of an upper housing which is adapted to be secured to the stern of a small boat. The pedal drive means is secured to the housing structure and is also supported by structures adjacent the stern of the boat. The drive shaft extends downwardly to the propeller which is supported by a lower housing, rotatable by the steering means.

A steering control operated by the hand of the operator is connected to the upper housing and therein connected to the rotatable lower housing on which the propeller and rudder are mounted.

Further advantages of the invention may be brought out in the following part of the specification wherein small details have been described for the competence of the disclosure, without intending to limit the scope of the invention which is set forth in the appended claims.

BRIEF DESCRIPTION OF THE DRAWINGS

Referring to the accompanying drawings which are for illustrative purposes.

BEST MODE FOR CARRYING OUT THE INVENTION

Figure 1:
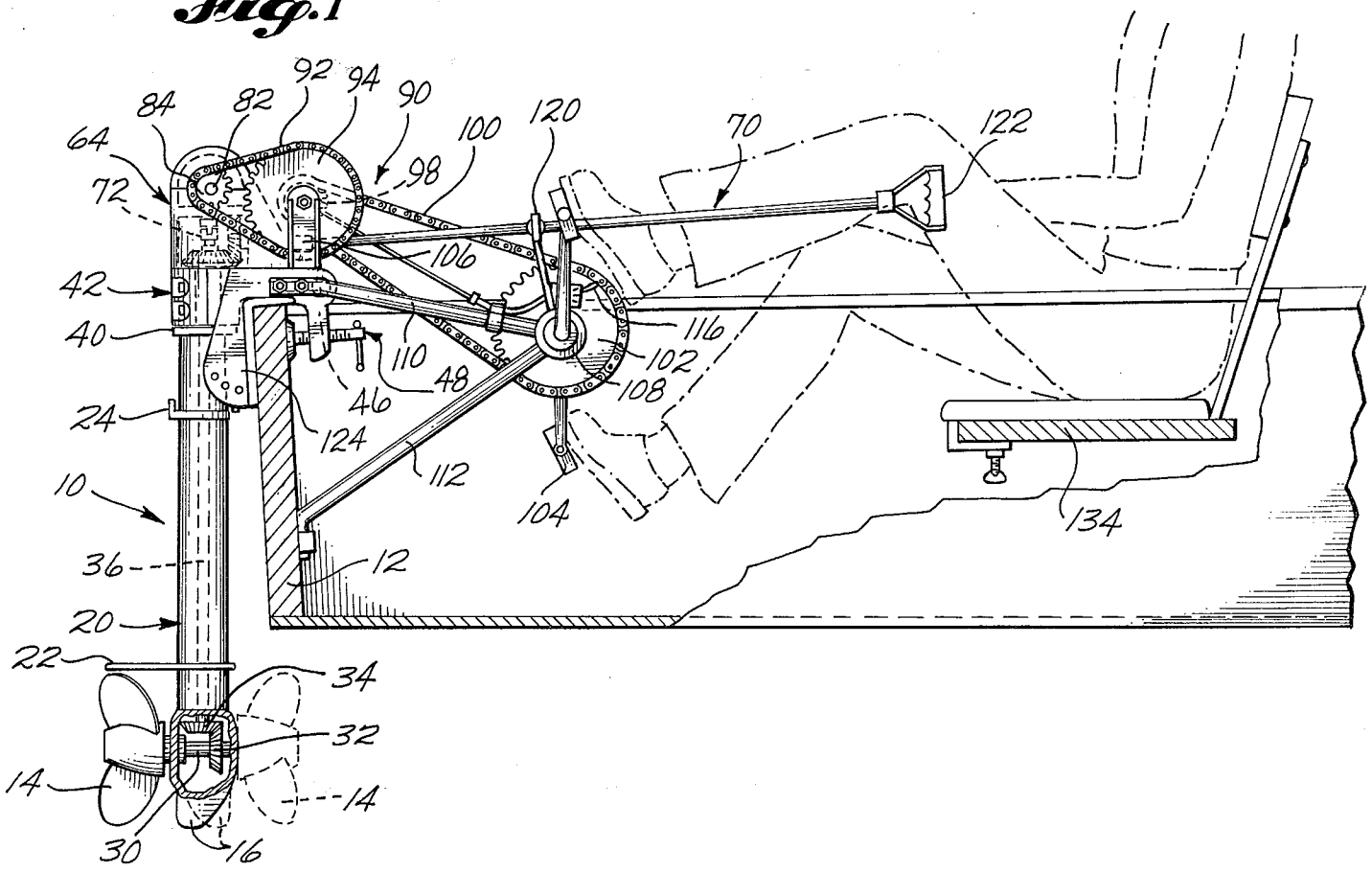
FIG. 1 is a side elevational view of the invention mounted in the stern of a boat and being operated by an operator facing rearwardly in the boat.

Referring again to the drawings, there is shown in FIG. 1, a propeller drive and steering assembly, generally designated as 10, removably secured to the stern of a small boat on a transom 12. The driving structure is comprised of a propeller 14 and a rudder 16 supported at the lower end of a generally cylindrical, elongated rotatable lower housing 20. Above the propeller is a cavitation plate 22 and upwardly thereof is hook 24 for engaging a hook 26, FIG. 4, for holding housing 22 vertical when the propeller is reversed, as shown in phantom outline in FIG. 1.

The propeller is mounted on a horizontal axle 30, FIG. 1, driven by a bevel gear 32. The gear 32 is meshed with a bevel gear 34 mounted for driving rotation at the lower end of drive shaft 36.

Figure 3:
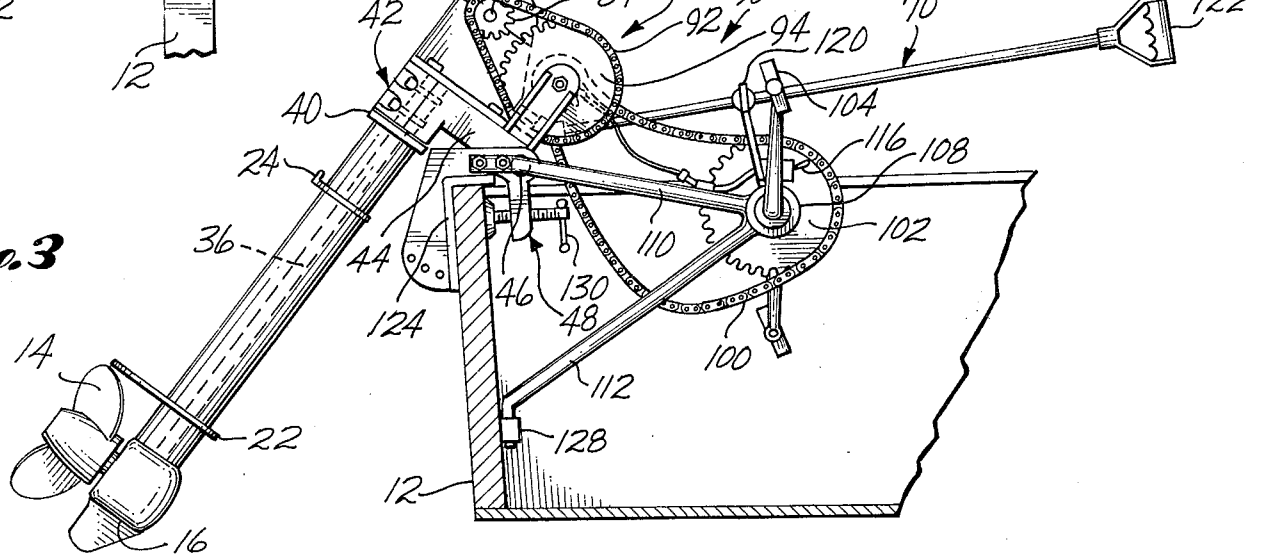
FIG. 3 is a fragmentary elevational view of the invention mounted on the boat with the propeller raised angularly on its support in the boat.
Figure 4:
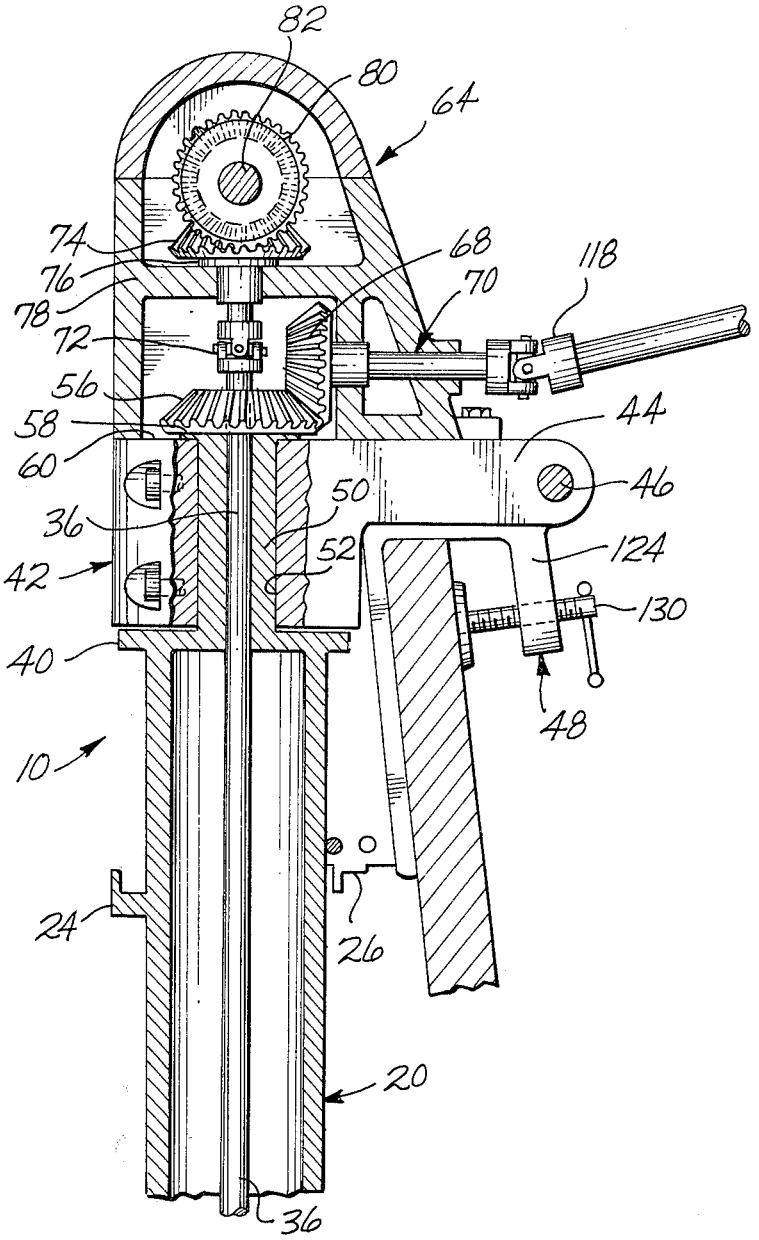
FIG. 4 is a fragmentary cross-sectional view of the drive shaft and steering device housings illustrating the mounting arrangement on the stern of the boat.

An annular flange 40, FIG. 4, on the housing 20 is spaced from the assembly support 42, having spaced arms 44, pivotally mounted at 46 to boat clamping means 48. The propeller 14 is pivoted upwardly in shallow water and during mounting and adjusting on the boat, for example, FIG. 3.

A small diameter portion 50, FIG. 4, of the housing 20 extends into a bore 52 for rotation relative to the support structure 42 and to the drive shaft 36. The upper end of portion 50 is secured for support in a steering device bevel gear 56, adapted to rotate on a thrust bearing 58, supported on surface 60 on supporting structure 42.

An upper housing 64, formed on the support 42, encloses the upper end of the drive shaft 36, small diameter portion 50 of the steering device, steering bevel gear 56, control steering bevel gear 68 connected to steering control rod 70, and the driving connections to the drive shaft.

The drive shaft 36 extends through and rotates independently of the steering bevel gear 56. Included in the drive shaft is a universal joint 72 to handle any out of line rotation of the drive shaft and propeller. The upper end of the drive shaft has a bevel gear 74, FIGS. 2 and 4, secured thereon, the bevel gear being rotatable on thrust bearing 76, supported on housing support wall 78.

A driving bevel gear 80 is meshed with gear 74 in the housing 64. The gear 80 is mounted on an axle 82, FIGS. 1–4, extending through the housing and driven by sprocket 84. The driving means, generally designated as 90, FIGS. 1–3, includes sprocket 84, driven by endless chain 92 via sprocket 94, the latter being driven by variable speed hub 96, FIG. 2. The hub is driven by sprocket 98 engaged with endless chain 100, driven by sprocket 102, in turn driven by an aft facing operator by rotating pedals 104.

The sprockets 94 and 98 and the hub 96 are supported on beams 106 extending from arms 44. The sprocket 102 and pedals 104 are mounted on hub 108, supported by beams 110 and 112, the former being supported on the clamp structure 48 and the latter by the transom 12. Speed changes are made in the hub 96 by positioning of a lever 116 supported on the hub 108.

The steering control rod 70 has an universal joint 118 to permit freedom of movement during rotation to change the heading of the boat. The rod is mounted in a bearing 120 supported on the hub 108 and is rotated by hand grip 122.

The assembly 10 is positioned on the boat by placing U-shaped brackets 124 of the clamp device 48 on the top of transom 12. This may be conveniently accomplished in some situations by holding the housings 20 and 64 in the position shown in FIG. 3 and lifting the proper assembly portions into the boat. The assembly is then secured in the boat by placing supports 112 into channels 128 secured on the transom and by tightening the screw clamps 130 against the transom.

A rearwardly facing operator's seat 134 is adjustably positioned so that the operator can comfortably pump the pedals 104 and reach the steering control hand grip 122.

In normal trolling, the operator rotates the pedals 104 to achieve the desired boat speed. Rotation of the pedals drives the chains and sprockets to rotate the drive shaft 36 in the housings and to rotate the propeller 14 to drive the boat.

Figure 2:
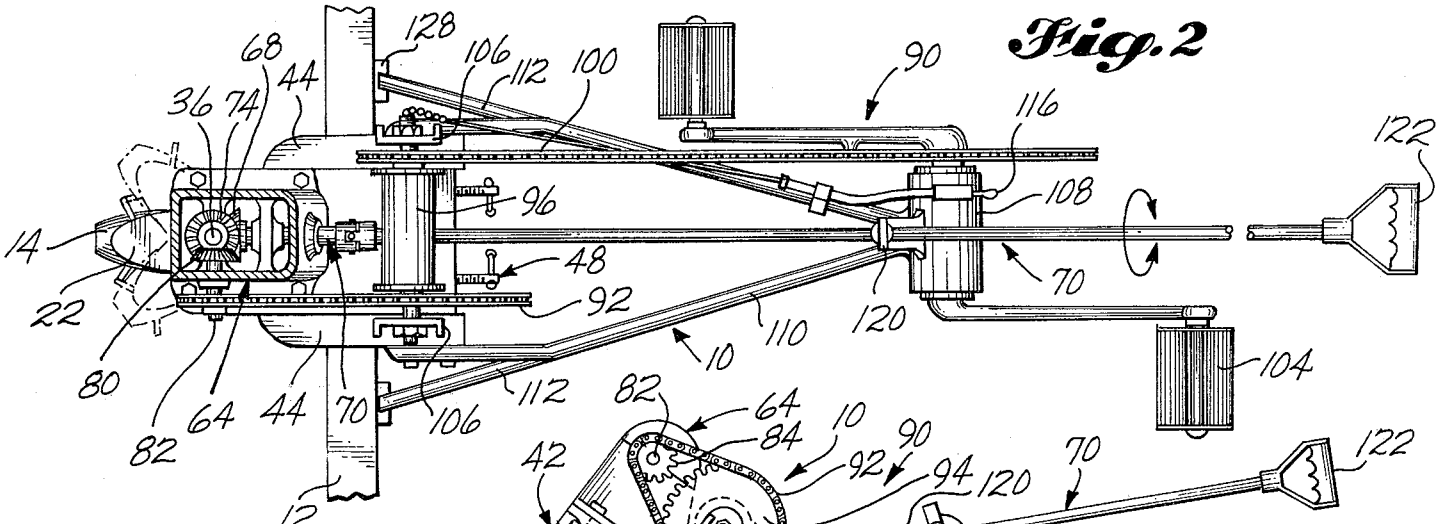
FIG. 2 is a fragmentary plan view of the invention as shown in FIg. 1.

The proper boat heading is obtained by rotating the steering control hand grip 122 to rotate the rod 70, the gears 68, 56, the housing 20 and the propeller 14 and the rudder 16 relative to the drive shaft 36, as indicated in FIG. 2.

To put the assembly in reverse, the housing 20 is rotated 180 degrees to engage the hook 24 in the hook 26, FIG. 4, and the propeller and rudder in the positions shown in phantom outline in FIG. 1.

While the operator is performing all or any of the foregoing operations, it is easy for him to maintain his fishing rod in the trolling or other positions, holding it in one or both hands.

The use of the bevel gears 56, 68 provides an essentially one to one relationship between the rotation of rod 70 and a corresponding rotation of the housing 20. That is, 90 degree rotation of rod 70 will result in approximately 90 degree rotation of housing part 20. An exact one to one relationship can be established by making the two bevel gears 56, 68 identical in size.

The invention and its attendant advantages will be understood from the foregoing description and it will be apparent that various changes may be made in the form, construction, and arrangements of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims.

I claim:

1. A foot pedal driven propeller drive and hand operated steering assembly for a boat, comprising:

a mounting frame that is detachably connectable to a blunt end of a boat;

said frame including an upper housing which in use is positioned endwise outwardly of the blunt end of the boat, and an inner end which is positioned in the boat inwardly of the blunt end of the boat;

a rotatable lower housing, mounted for rotation about a vertical axis, and depending from the upper housing, and carrying a propeller at its lower end;

vertical drive shaft means extending through the rotatable lower housing and at its upper end projecting into the upper housing, and at its lower end being drivingly connected to a propeller;

foot pedal operated drive crank means supported at the inner end of said frame;

drive transmission means interconnected between the foot pedal driven drive means and the upper end of said vertically oriented drive shaft; and hand operatable steering means connected to the rotatable lower housing and including a first bevel gear within said upper housing, a second bevel gear meshing with the first bevel gear, and rotatable control rod means extending laterally outwardly of said upper housing from the second bevel gear to a position which is inwardly of the boat from the blunt end of the boat, and a control handle secured to the inner end of the rotatable control rod;

said bevel gears providing a substantially one to one drive relationship between the control rod and the rotatable lower housing;

whereby an operator sitting in a boat on which such assembly is mounted, in a seat positioned inwardly of the boat from the pedal drive, is able to propel the boat by his feet and steer and reverse the boat by a simple hand rotation of the control rod, while facing towards the blunt end of the boat.

2. The invention according to claim 1, wherein the frame includes a first part which is detachably mountable onto the blunt end of the boat and a second part which is mounted onto the first part, for pivotal movement about a horizontal axis between raised and lowered positions, wherein said second part includes both the upper housing and the rotatable lower housing depending therefrom, and wherein said drive transmission means comprises a first sprocket wheel connected to the drive crank means to be driven thereby, a second sprocket connected to the upper housing of the frame, to be movable therewith, and a drive chain extending about and interconnecting the two sprockets, said drive chain being sufficiently taut when the second part of the frame is in its lowered position to transmit drive motion from the first sprocket to the second sprocket.

3. The invention according to claim 2, including:

a universal joint in said control rod means.

* * * * *